US010357411B2

(12) United States Patent
Pelletier et al.

(10) Patent No.: US 10,357,411 B2
(45) Date of Patent: Jul. 23, 2019

(54) RAPID EXTRACTION TOOL

(71) Applicants: Donald Pelletier, Saint-Hubert (CA); Pierre Pelletier, Bromont (CA)

(72) Inventors: Donald Pelletier, Saint-Hubert (CA); Pierre Pelletier, Bromont (CA)

( * ) Notice: Subject to any disclaimer, the term of this patent is extended or adjusted under 35 U.S.C. 154(b) by 0 days.

(21) Appl. No.: 15/732,657

(22) Filed: Dec. 8, 2017

(65) Prior Publication Data

US 2018/0104119 A1 Apr. 19, 2018

Related U.S. Application Data

(63) Continuation-in-part of application No. 14/545,522, filed on May 14, 2015.

(51) Int. Cl.

| | |
|---|---|
| ***A61G 1/013*** | (2006.01) |
| ***A61G 1/02*** | (2006.01) |
| ***A61G 1/017*** | (2006.01) |
| ***A61G 7/10*** | (2006.01) |
| ***A62B 3/00*** | (2006.01) |
| ***A61G 1/052*** | (2006.01) |
| ***A61G 1/003*** | (2006.01) |
| *A62B 5/00* | (2006.01) |
| *A61G 1/044* | (2006.01) |
| *A62B 35/00* | (2006.01) |

(52) U.S. Cl.

CPC ..... *A61G 1/013* (2013.01); *A61G 1/003* (2013.01); *A61G 1/052* (2013.01); *A61G 7/1011* (2013.01); *A61G 7/1015* (2013.01); *A61G 7/1051* (2013.01); *A62B 3/00* (2013.01); *A61G 1/044* (2013.01); *A62B 5/00* (2013.01); *A62B 35/0006* (2013.01)

(58) Field of Classification Search

CPC ..... A61G 1/013; A61G 1/052; A61G 1/044; A61G 7/1011; A61G 7/1051; A61G 1/00; A61G 1/02; A61G 1/017; A61G 1/003; A61G 7/10; A61G 7/1023; A61G 7/1038; A62B 3/00; A62B 5/00; A62B 35/0006

See application file for complete search history.

(56) References Cited

U.S. PATENT DOCUMENTS

| | | | | |
|---|---|---|---|---|
| 1,656,701 A * | 1/1928 | Eustace | ..... | A45F 3/10 280/19 |
| 2,947,007 A * | 8/1960 | Oades | ..... | A61G 1/013 5/627 |
| 3,574,871 A * | 4/1971 | Greene | ..... | A61G 1/003 5/627 |

(Continued)

*Primary Examiner* — Nicholas F Polito
*Assistant Examiner* — Rahib T Zaman
(74) *Attorney, Agent, or Firm* — Eric Fincham

(57) ABSTRACT

A device for rescuing a downed firefighter comprising a first rigid non flammable leg having a proximal end and a distal end, a second rigid non flammable leg having a proximal end and a distal end, a connecting member, the proximal end of the first leg and the second leg being connected to the connecting member, the first and second rigid non flammable legs diverging outwardly from the proximal ends to the distal ends, a grasping element being secured to the connecting member, at least one flexible cross member extending between the first leg and the second leg, and at least one flexible strap secured to at least one of the legs or cross member. The device is particularly useful for rescuing downed firefighters.

10 Claims, 5 Drawing Sheets

(56) References Cited

U.S. PATENT DOCUMENTS 3,813,712 A * 6/1974 Bonnin ..... A47C 23/14 5/110
4,132,427 A * 1/1979 McGee ..... B62B 5/068 280/19
4,216,556 A * 8/1980 Haeussinger ..... A61F 5/05883 5/114
4,286,739 A * 9/1981 Silcott ..... A45F 4/02 224/153
4,742,822 A * 5/1988 Guerriero ..... A61F 5/3776 5/628
6,842,923 B1 * 1/2005 Castellani ..... A61G 1/013 16/228
8,104,124 B2 * 1/2012 Awerbuch ..... A61G 1/013 5/111
8,127,381 B2 * 3/2012 Westmoreland, II .. A61G 1/013 5/176.1
8,936,253 B1 * 1/2015 Rizzi ..... A61G 1/013 280/17
2002/0162171 A1 * 11/2002 Faz ..... A61G 1/013 5/627
2004/0010852 A1 * 1/2004 Bourgraf, Jr. ..... A61G 1/013 5/627
2010/0025149 A1 * 2/2010 Harrison ..... A61G 1/00 182/21
2010/0176619 A1 * 7/2010 Cahaan ..... A61G 1/013 296/20
2010/0237111 A1 * 9/2010 Mroczka ..... A45F 3/04 224/156
2011/0177733 A1 * 7/2011 Grimes ..... A61G 1/02 441/80
2013/0036552 A1 * 2/2013 Davis ..... A61G 1/00 5/628
2013/0086748 A1 * 4/2013 Walter ..... A61G 1/013 5/627
2015/0082544 A1 * 3/2015 Yancovitch ..... A61G 1/017 5/628

* cited by examiner

RAPID EXTRACTION TOOL

The present application is a continuation-in-part of application Ser. No. 14/545,522 filed May 14, 2015, the teachings of which are hereby incorporated by reference.

FIELD OF THE INVENTION

The present invention relates to a device for removing/transporting a person suffering from an injury and to a method for transporting the person.

BACKGROUND OF THE INVENTION

There are many situations wherein an injured person must be transported from a first place (usually the place of injury) to a safer location or treatment facility. Although such a situation can occur in many different applications, the description herein will focus on the case of firefighters. However, it will be understood that the device and method may be used in many different situations where it is necessary to transport an injured individual.

There are many devices known in the art for transporting injured individuals. They usually consist of a backboard onto which the injured person is secured. Subsequently, the board can be lifted by a pair of individuals. Such a device is particularly useful in the case of back injuries wherein the person can be immobilized on the backboard.

Firefighting is inherently a very dangerous occupation and firefighters must undergo in-depth training to respond to a variety of situations. One of the most dangerous situations involves a situation wherein a firefighter has entered a building or other structure and is subsequently trapped in the building. This frequently occurs when debris falls on the firefighter.

Most fire departments maintain a staff of individuals who are specifically trained to rescue firefighters who are downed. The situation is extremely difficult and dangerous since there is also a high degree of danger to the rescuers. It is inherently difficult to attempt to rescue an individual in such a situation. It will be understood that the individual represents a dead weight of 250-350 pounds and the rescuers must often operate in situations wherein visibility is limited or nil. Furthermore, the equipment which the firefighters and rescuers utilize is not designed to provide a tactile response in the sense that the gloves do not permit a feedback of what the hands are doing.

Other problems which exist are the transportation of the downed firefighter. As above mentioned, the sheer weight of the person with the heavy equipment on poses a substantial problem. At present, the downed firefighter is carried by one or more rescuers to a place of evacuation. Frequently, the only way out of some buildings is by means of a window which presents the problem of passing the person through the window to other firefighters on ladders and the like.

SUMMARY OF THE INVENTION

It is an object of the present invention to provide an apparatus suitable for transporting an individual from a first location to a second location.

It is a further object of the present invention to provide a method of transporting an individual from a first location to a second location.

According to one aspect of the present invention, there is provided a device for rescuing a downed firefighter comprising a first rigid non flammable leg having a proximal end and a distal end, a second rigid non flammable leg having a proximal end and a distal end, a connecting member, the proximal end of the first leg and the second leg being connected to the connecting member, the first and second rigid non flammable legs diverging outwardly from the proximal ends to the distal ends, a grasping element being secured to the connecting member; at least one flexible cross member extending between the first leg and the second leg; and at least one flexible strap secured to at least one of the legs or cross member.

According to a further aspect of the present invention, there is provided a method for rescuing a downed firefighter comprising the steps of, supplying a device as set forth above, securing an individual to the device using the at least one strap, and securing a cable to the grasping element, placing the distal ends of the first and second legs against an abutting surface, and pulling on the cable to thereby lift one end of the device to a vertical position.

The first and second legs provide the rigidity to the structure and accordingly, are formed of a suitable material. Naturally, it is preferred that the material be non flammable or at least fire resistant and to this end, a suitable metallic or composite material may be utilized.

Preferably, the legs are telescopic in nature. For east of adjustment, this telescopic arrangement is preferably situated proximate the distal end, although other arrangements can be utilized. Various types of telescopic structures are known in the art and any suitable one may be utilized in the practice of the present invention.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
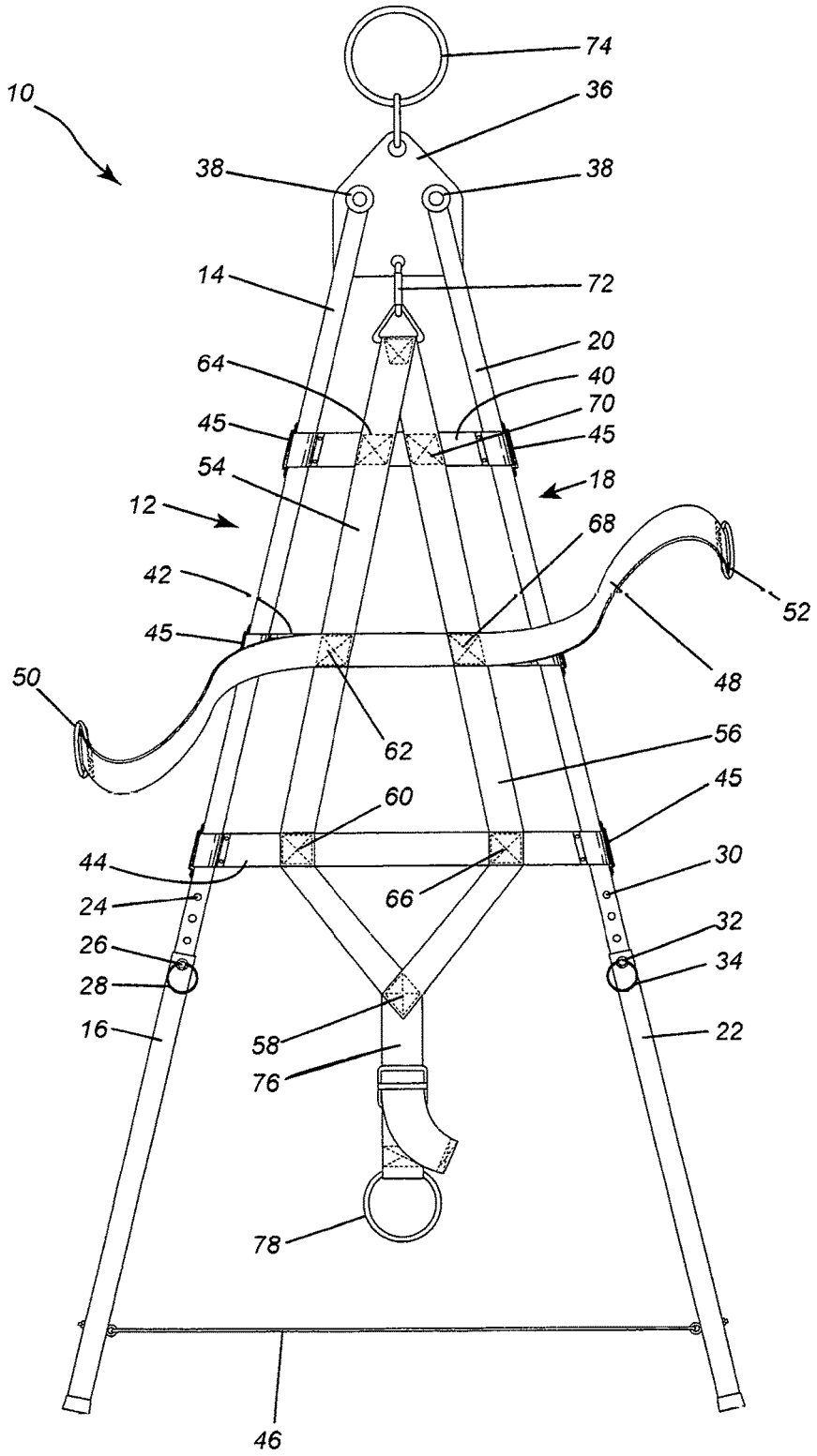
FIG. 1 is a plan view of a device according to the present invention.

Referring to the drawings in greater detail and by reference characters thereto, there is illustrated an extraction device for extracting or transporting a person and which device is generally designated by reference numeral 10.

Device 10, as may be seen in FIG. 1, has a first leg which is generally designated by reference numeral 12. First leg 12 in turn is formed of an upper portion 14 and a lower portion 16. Upper portion 14 and lower portion 16 are telescopic in nature. Thus, the distal end of upper portion 14 has a series of apertures 24. A pin 26 may be placed through an aperture in lower portion 16 at one of the selected apertures 24 to provide a desired length to the first leg 12. A ring 28 is provided for manipulating pin 26.

A second leg is generally designated by reference numeral 18 and in a manner similar to first leg 12, has an upper portion 20 and a lower portion 22. The distal end of upper portion 20 has a series of apertures 30 which permit a pin 32 to be inserted to provide a desired length to second leg 18. A ring 34 is secured to pin 32 for ease of manipulation of pin 32.

At their proximal end, upper portion 14 of first leg 12 and upper portion 20 of second leg 18 are secured to a connecting member 36. Preferably, the connection is such that connectors 38 permit pivotable movement of first leg 12 and second leg 18.

Extending between upper portion 14 of first leg 12 and upper portion 20 of second leg 18 are a plurality of web members. A first web member 40 extends around upper portions 14 and 20 and are held in position by means of a guide member 45. In the illustrated embodiment, the ends of web member 40 are secured to the main portion thereof.

A second web member 42 and a third web member 44 are arranged in a similar fashion.

The distal ends of lower portions 16 and 22 are secured together by means of a flexible cable 46.

The device includes a strap 48 having buckles 50, 52 at respective ends thereof for securement together about the body of a person to be transported.

Device 10 also includes a first longitudinal web 54 and a second longitudinal web 56. First longitudinal web 54 has an end secured through second longitudinal web 56 at point 58. Longitudinal web 54 is also secured to third, second and first web members 44, 42, and 40 at securement points 60, 62 and 64. Similarly, second longitudinal web 56 is secured at points 66, 68 and 70. As will be noted, first and second longitudinal webs 54, 56 are in reality a single piece of material which is looped about a connecting element 72 which is secured to connecting member 36. A grasping element 74 is a ring which is secured to connecting member 36. It will also be noted that there is provided a strap 76 and a grasping ring 78 at the other end of longitudinal webs 54, 56.

Figure 2:
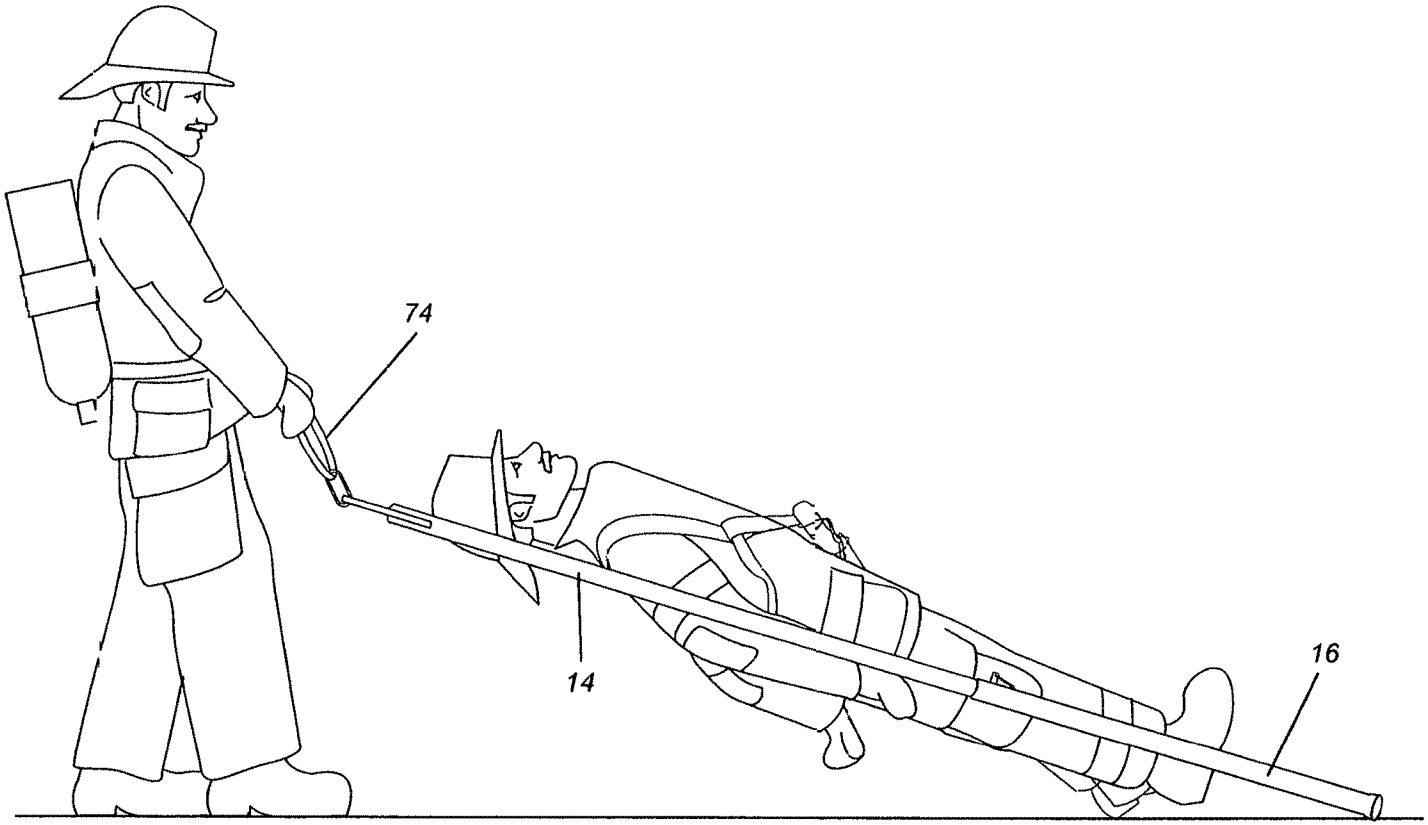
FIG. 2 is a side elevational view illustrating use of the device in a first mode.

As shown in FIG. 2, device 10 may be utilized to pull a downed firefighter along a surface. Normally, a single person would be able to use the device to accomplish this. However, it will be understood that the distal end of first leg 12 and second leg 18 could be grasped and carried by a second person.

Figure 3:
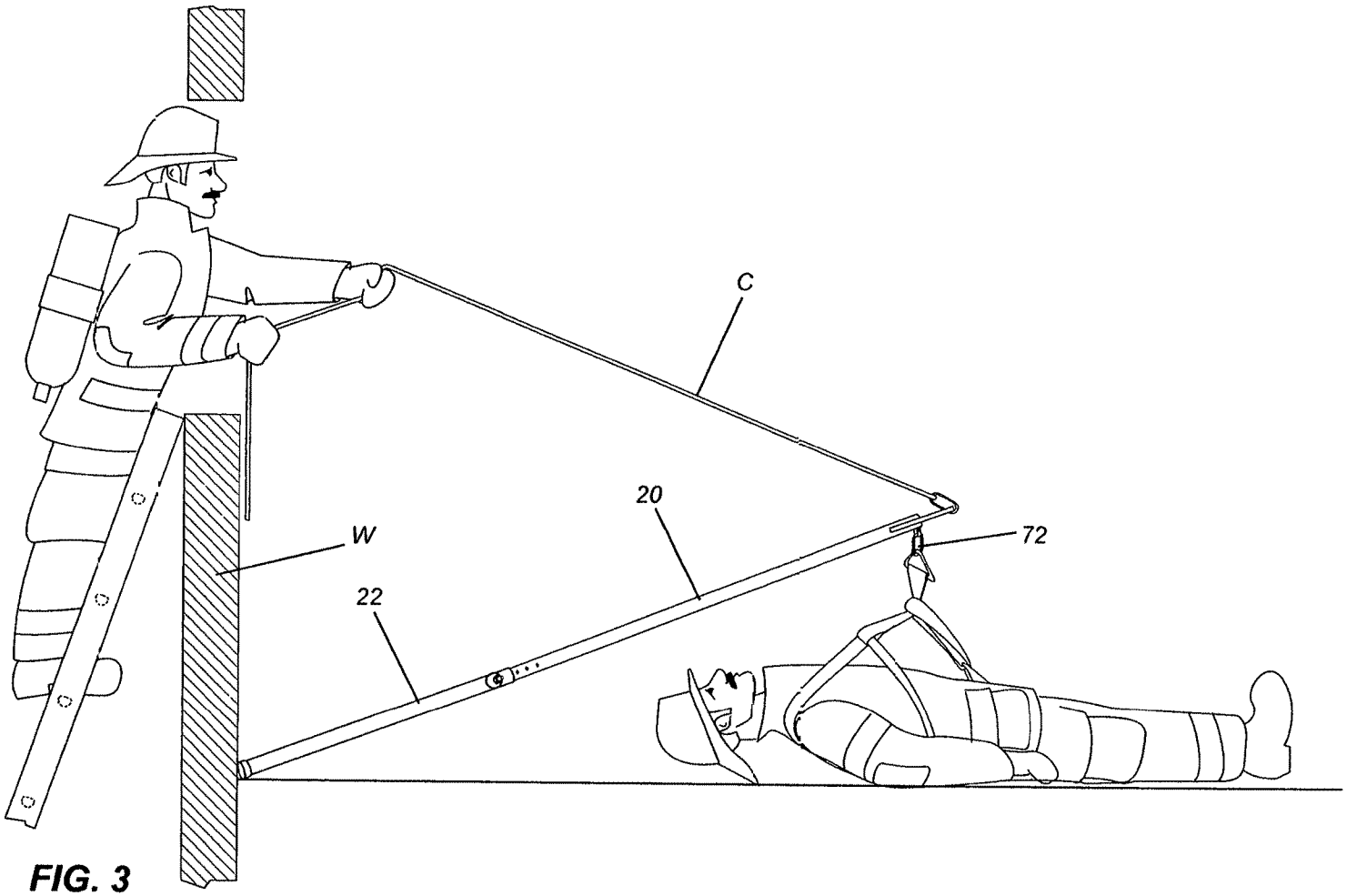
FIG. 3 is a side elevational view illustrating use of the device to extract a fireman.
Figure 4:
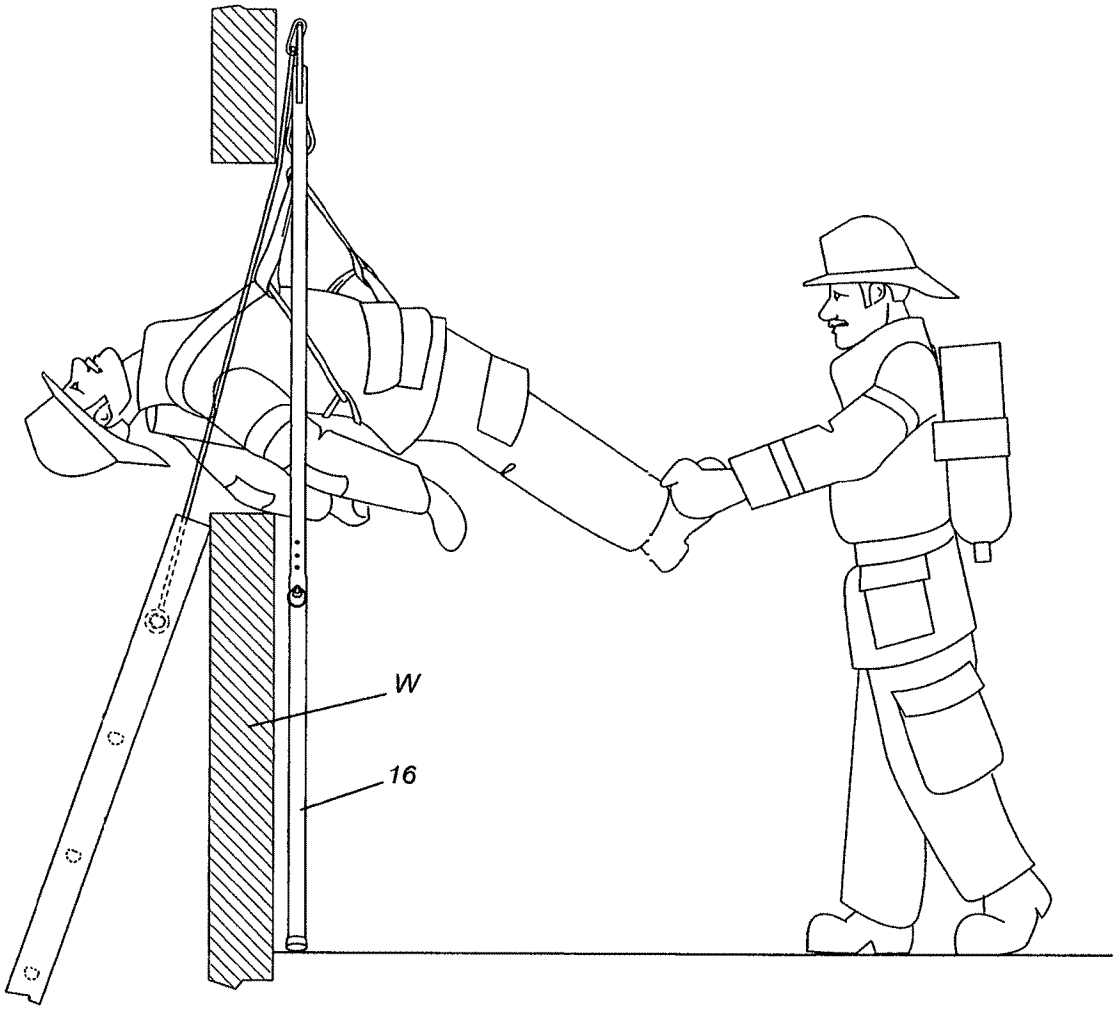
FIG. 4 is a view similar to FIG. 3 illustrating use of the device.
Figure 5:
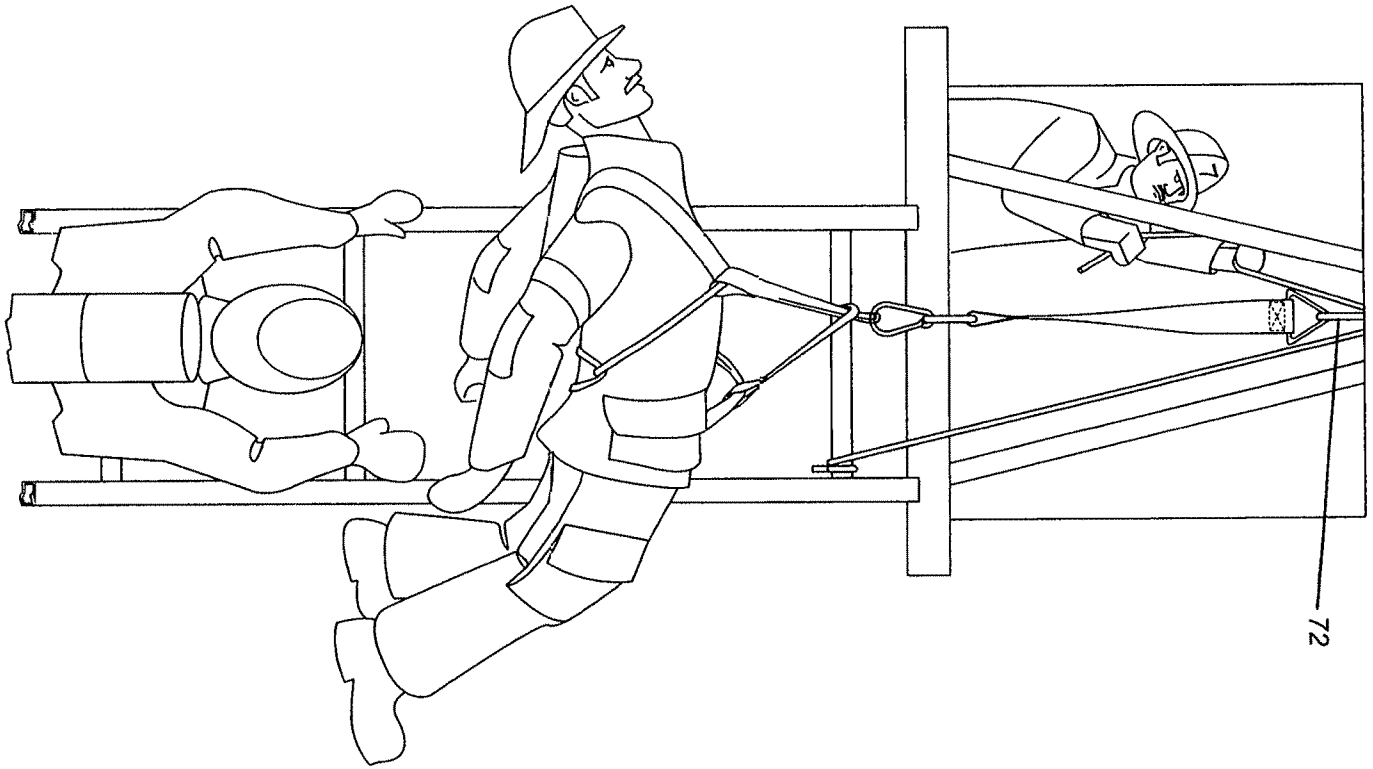
FIG. 5 is a view illustrating the lowering of a rescued fireman.

FIGS. 3, 4 and 5 illustrate use of the device 10 to extract a downed firefighter. As may be seen, the device is anchored against a wall W and a cable C is utilized to pick up the downed firefighter. The use of the tool or device permits the passage of the downed firefighter through a window from which he may be lowered down a ladder.

It will be understood that the above described embodiment is for purposes of illustration only and that changes and modifications may be made thereto without departing from the spirit and scope of the invention.

We claim:

1. A device for rescuing a downed firefighter comprising:

a first rigid non flammable leg having a proximal end and a distal end;

a second rigid non flammable leg having a proximal end and a distal end;

a connecting member, the proximal end of said first leg and said second leg being connected to said connecting member;

said first and second rigid non flammable legs diverging outwardly from said proximal ends to said distal ends;

a grasping element being secured to said connecting member;

at least one flexible cross member extending between said first leg and said second leg;

first and second longitudinally extending straps, said first and second longitudinally extending straps each being connected at a first end thereof to said connecting member and being connected at a second end thereof to said flexible cross member, said first longitudinally extending strap being parallel to said first rigid non flammable leg, said second longitudinally extending straps being parallel to said second rigid non flammable leg; and at least one flexible strap secured to at least one of said legs or cross member.

2. The device of claim 1 wherein said first leg and said second leg are telescopic proximate said distal end.

3. The device of claim 1 wherein said device has a plurality of flexible cross members extending between said first and second legs.

4. The device of claim 3 further including longitudinally extending straps secured to said flexible cross members.

5. The device of claim 3 wherein said grasping element comprises a ring like member.

6. The device of claim 1 wherein said at least one strap includes a buckle arrangement to secure an individual placed on said device.

7. The device of claim 5 further including at least one flexible member interconnecting said first and second legs proximate their distal ends.

8. A method for rescuing a downed firefighter comprising the steps of;

supplying a device according to claim 1;

securing an individual to said device using said at least one strap; and securing a cable to said grasping element;

placing said distal ends of said first and second legs against an abutting surface; and pulling on said cable to thereby lift one end of said device to a vertical position.

9. The device of claim 1 wherein said connecting member, said grasping element, said one cross member and said at least one strap are formed of non flammable materials.

10. The device of claim 1 wherein said at least one strap has a buckle at either end thereof, said buckles being securable together.

* * * * *